United States Patent [19]

Smith et al.

[11] Patent Number: 4,824,150

[45] Date of Patent: Apr. 25, 1989

[54] FIRE RESPONSIVE SAFETY DOOR ASSEMBLY

[75] Inventors: Gregg L. Smith, Rolling Hills Estates; Mansam Choi, Monrovia, both of Calif.

[73] Assignee: Adams Rite Manufacturing Company, City of Industry, Calif.

[21] Appl. No.: 161,952

[22] Filed: Feb. 29, 1988

[51] Int. Cl.[4] ..... E05B 65/10; E05C 3/36

[52] U.S. Cl. ..... 292/92; 292/279; 292/DIG. 66

[58] Field of Search ..... 292/21, 92, 279, 280, 292/DIG. 69, DIG. 66

[56] References Cited

U.S. PATENT DOCUMENTS

| | | | |
|---|---|---|---|
| 420,834 | 1/1890 | Seib . | |
| 3,122,388 | 2/1964 | Powers . | |
| 3,638,984 | 2/1972 | Davidson . | |
| 3,705,739 | 12/1972 | Adler | 292/92 |
| 3,811,717 | 5/1974 | Floyd et al. | 292/92 |
| 3,861,727 | 1/1975 | Froerup et al. . | |
| 4,015,869 | 4/1977 | Horvath | 292/DIG. 66 X |
| 4,183,565 | 1/1980 | Allemann | 292/DIG. 66 X |
| 4,458,928 | 7/1984 | Hirschbein | 292/92 |
| 4,626,010 | 12/1986 | Hanchett, Jr. et al. . | |
| 4,709,950 | 12/1987 | Zortman | 292/92 |
| 4,726,613 | 2/1988 | Foshee | 292/DIG. 66 X |

*Primary Examiner*—Peter R. Brown

*Attorney, Agent, or Firm*—William W. Haefliger

[57] ABSTRACT

A door retention assembly locks a door in closed position in response to high temperature as during a fire, the door element having an edge portion closable into adjacent relation to an edge portion defined by a header element, and there being a strike carried by one of the elements. The assembly includes:

(a) a latch carried by the other element to relatively move into latching relation with the strike when the door element is closed relative to the header element, thereby to hold the door closed, (b) and a control to control movement of the latch into and out of latching relation with the strike. A heat fusible part, when fused, renders the control inoperable to effect movement of the latch out of latching relation with the strike.

8 Claims, 4 Drawing Sheets

FIRE RESPONSIVE SAFETY DOOR ASSEMBLY

BACKGROUND OF THE INVENTION

This invention relates generally to fire doors, and more particularly to a panic bar controlled door which is made non-openable in response to occurrence of high temperature that heats the door, as during a fire.

Panic bars normally are operable, when pushed, to quickly unlock doors. During building fire conditions, it is sometimes desirable to render the door non-openable, so as to prevent spread of the fire through door openings.

There is need for apparatus as disclosed herein, and which serves this purpose in a very simple, reliable, and highly efficient manner.

SUMMARY OF THE INVENTION

It is a major object of the invention to provide a door retention assembly meeting the above need. Basically, the assembly is operable to lock a door in closed position in response to high temperature conditions, as during a fire, and the assembly typically includes a door element having an edge portion closable into adjacent relation to an edge portion of a header element, there being a strike carried by one of these elements. In this environment, the invention combines:

(a) a latch carried by the other element to relatively move into latching relation with the strike when the door element is closed relative to the header element, thereby to hold the door closed, (b) and control means to control movement of the latch into and out of said latching relation with the strike, said means including a heat fusible part that, when fused, renders said control means inoperable to effect movement of the latch out of latching relation with the strike.

Typically, the control means includes a jamming part carried by said heat fusible part to become displaced into jamming relation with said control means in response to fusing of the fusible part; and the jamming part is in turn carried by the heat fusible part in a first position wherein said control means is not jammed, and said jamming part is dropped by said fusible part during heat fusing thereof, and into a second position wherein the control means is then jammed.

It is another object of the invention to provide the latch in the form of a rotor or starwheel engageable with the strike, the control means also including a keeper movable into and out of rotation blocking relation with the rotor. The assembly typically includes a frame, and the keeper is carried by the frame for movement into and out of rotation blocking relation with the starwheel, said control means including a jamming part carried by the heat fusible part to become displaced into jamming relation between the keeper and frame, in response to fusing of the fusible part.

It is a further object to provide a keeper and frame which in turn forms a pocket into which the jamming part drops in response to release of the jamming part by the heat fusible part in response to fusing of the fusible part. The heat fusible part is then carried by the keeper, and the jamming part is carried by the heat fusible part to overhang the pocket. The panic bar operates the keeper, and is carried by the door.

These and other objects and advantages of the invention, as well as the details of an illustrative embodiment, will be more fully understood from the following specification and drawings, in which:

DRAWING DESCRIPTION

Figure 2:
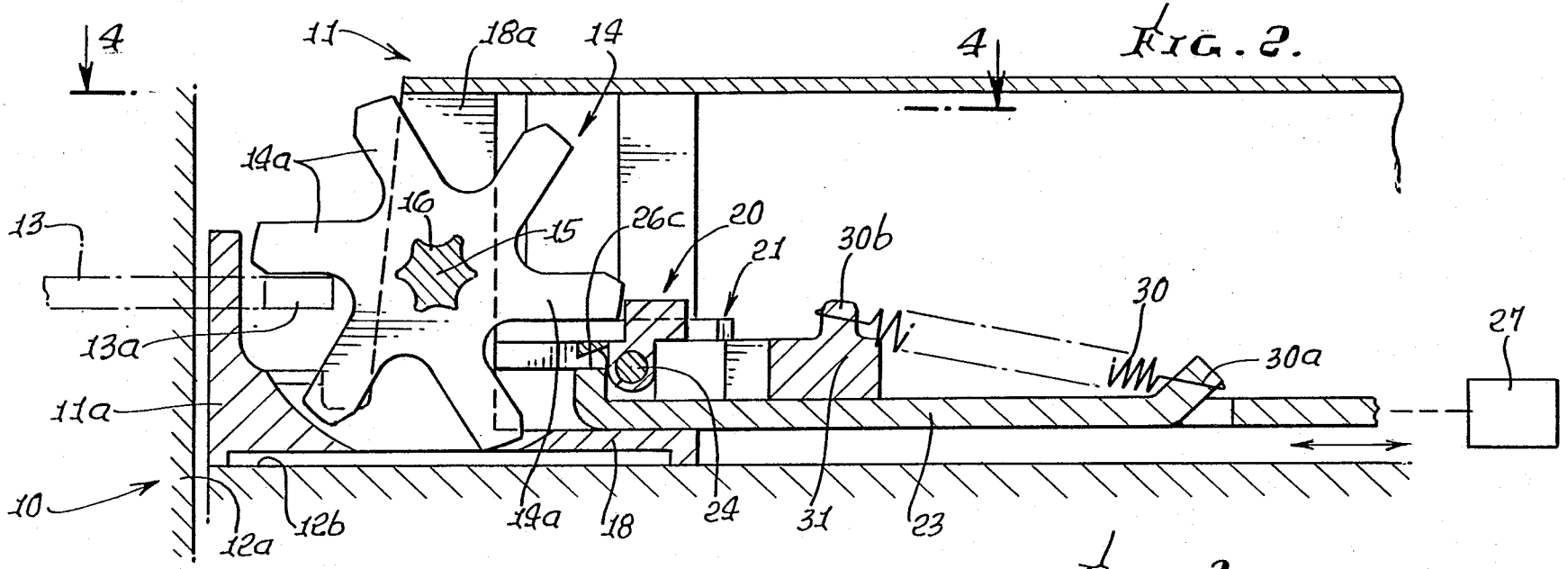
FIG. 2 is an enlarged section taken on lines 2—2 of FIG. 1, showing a starwheel blocked against rotation.
Figure 3:
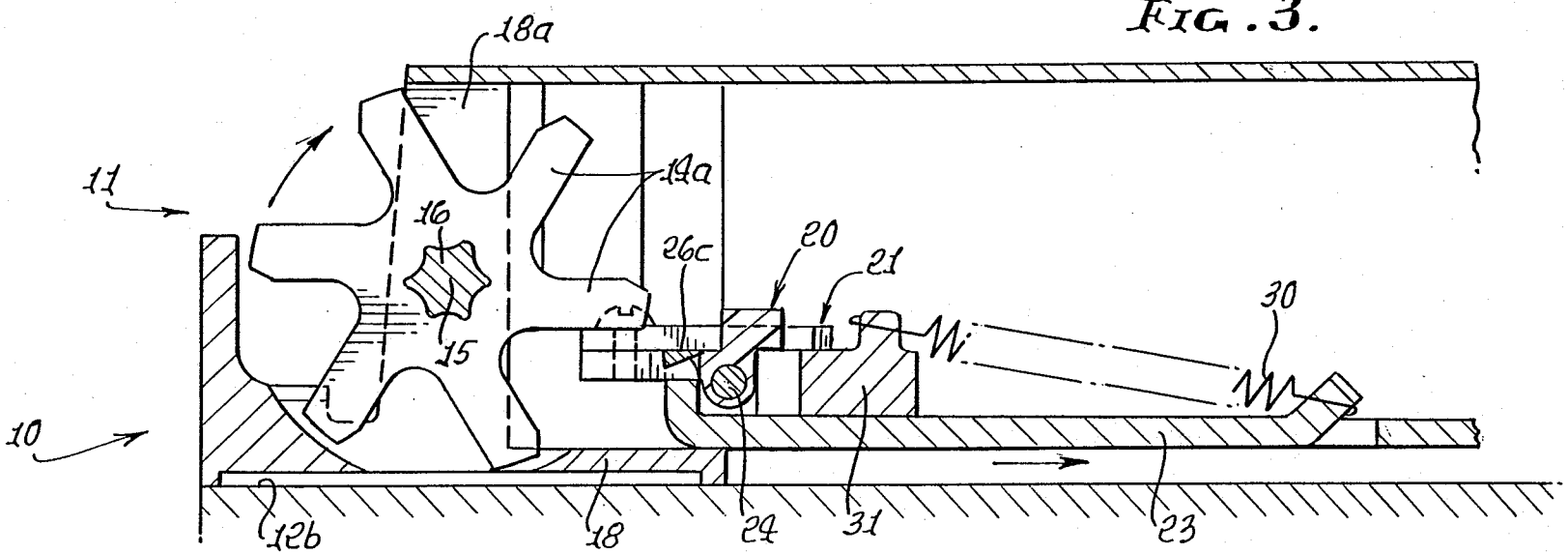
FIG. 3 is a view like FIG. 2, showing the starwheel in unblocked state.
Figure 5:
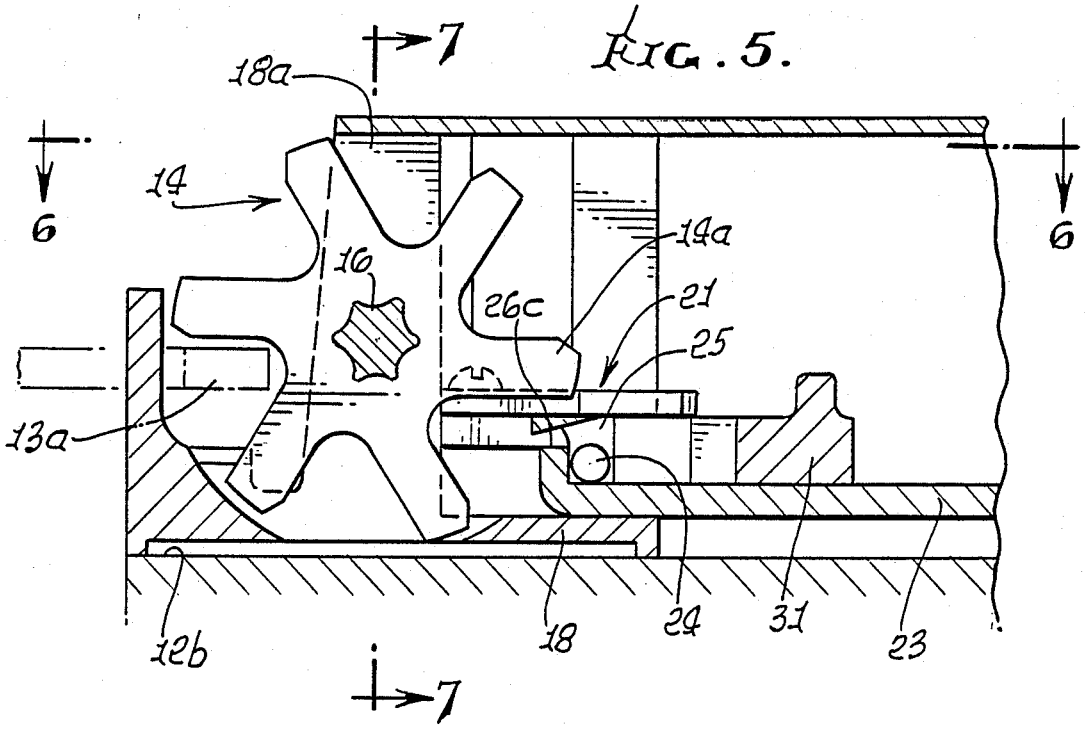
Figure 6:
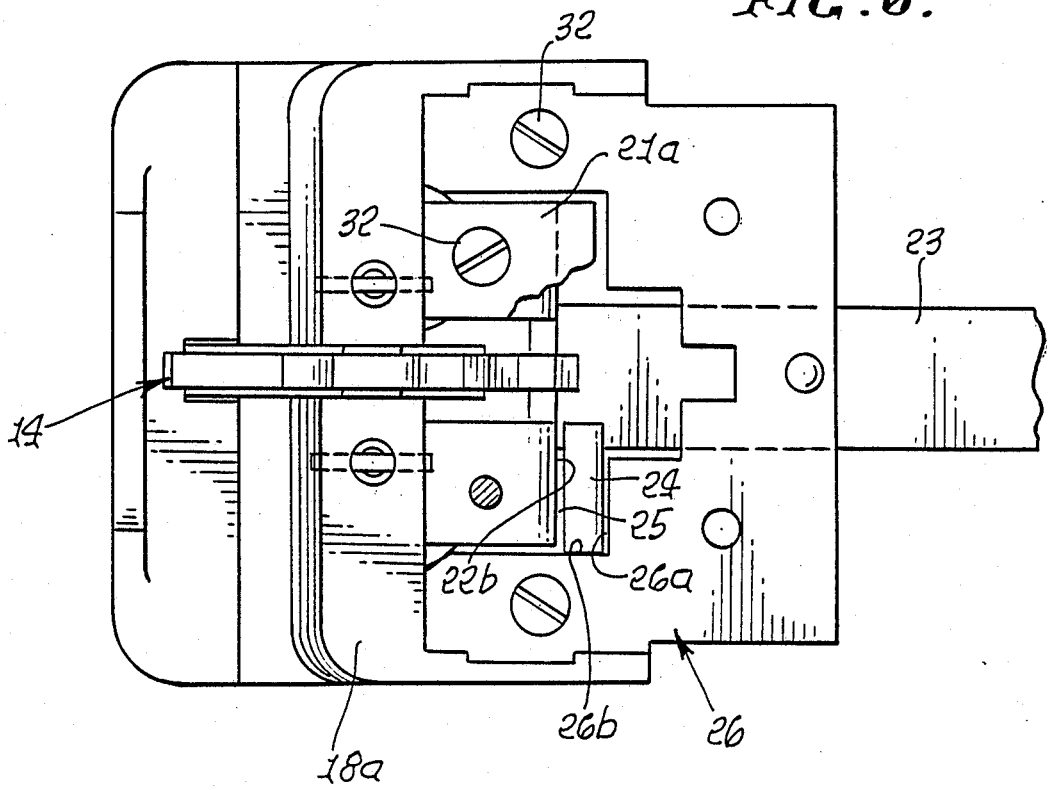
Figure 7:
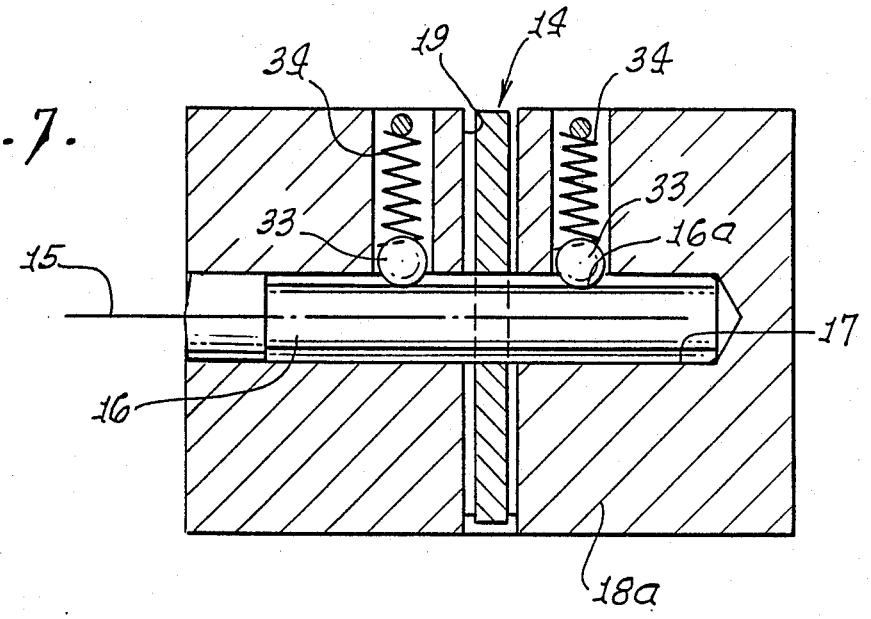
Figure 8:
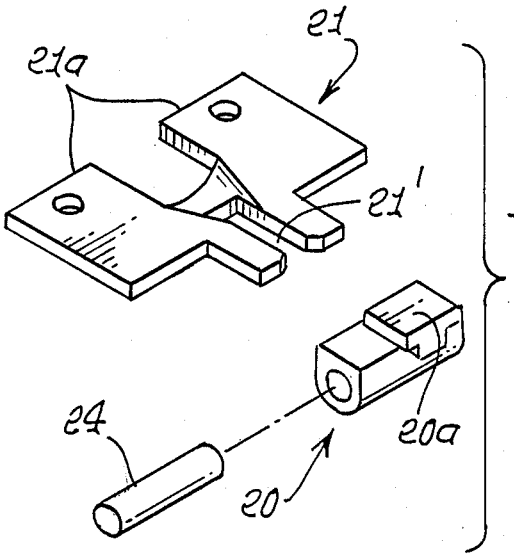
Figure 9:
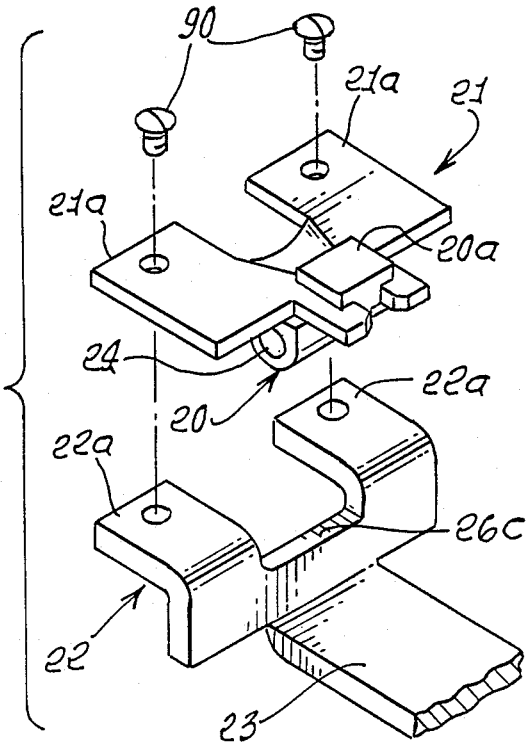

FIG. 5 a view like FIG. 2, but showing the parts after melting of a blocking pin holder;

FIG. 6 is an elevation on lines 5—5 of FIG. 5, showing drop-down position of a blocking pin;

FIG. 7 is a fragmentary section on lines 7—7 of FIG. 5; FIG. 8 is a perspective view of a starwheel holder; and FIG. 9 an exploded view of the starwheel holder, the blocking pin, and meltable holder for the blocking pin.

DETAILED DESCRIPTION

The door retention assembly seen at 10 in the drawings serves to lock a door element, as at 11, in closed position relative to a header element 12. These elements typically may extend vertically, as seen in FIG. 1.

Figure 1:
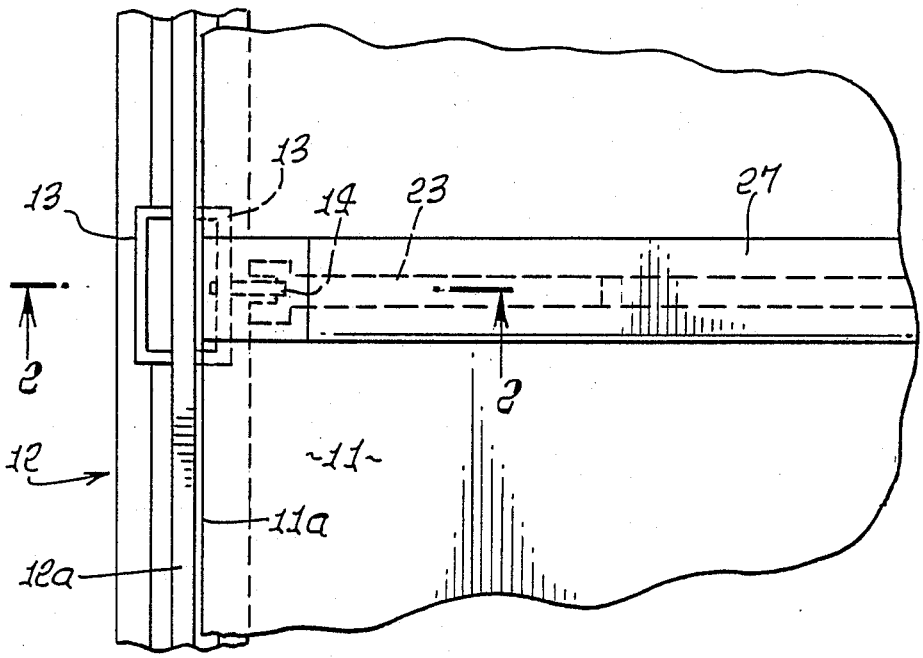
FIG. 1 is an elevation showing a door, and door retention assembly.
Figure 4:
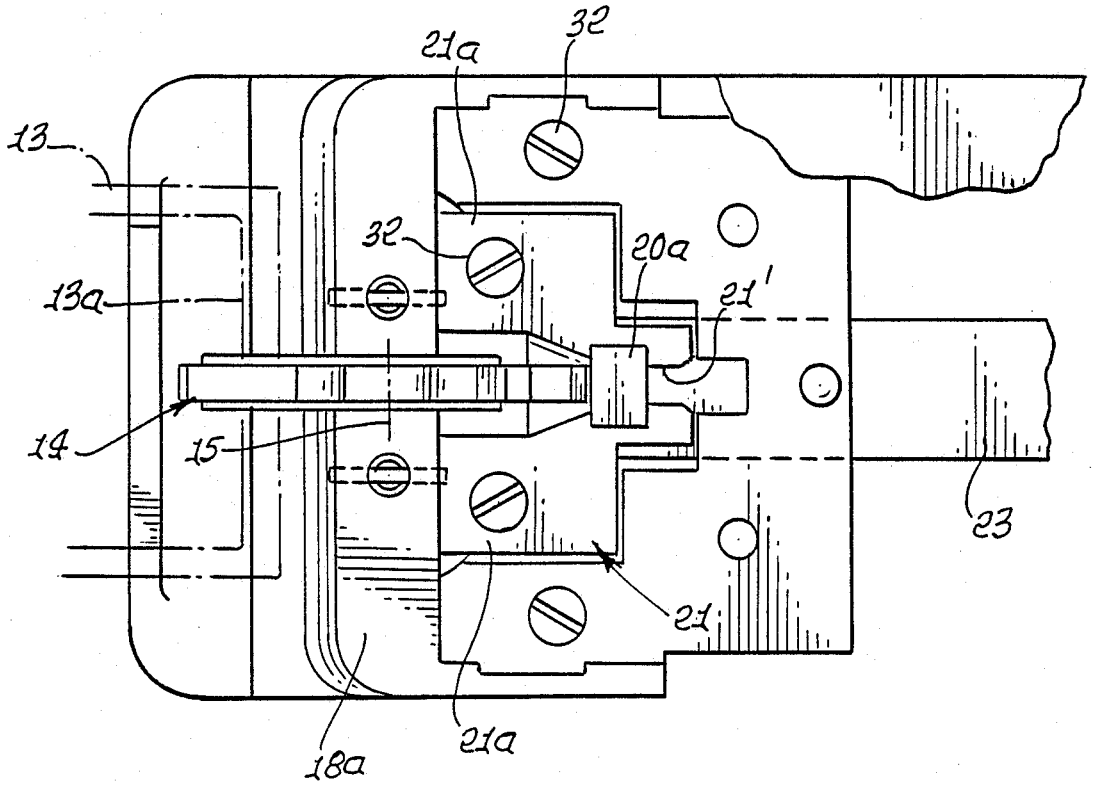
FIG. 4 is an elevational view on lines 4—4 of FIG. 2.

A door edge portion appears at 11*a*, and a header edge portion at 12*a*, and they are relatively closable into adjacent relation, as in response to door closing, as seen in FIGS. 1 and 2, for example. A door stop on the header appears at 12*b*. A strike 13 is carried by one element, and projects toward the door edge portion.

In accordance with the invention, a latch is carried by the other element, i.e. the door element for example, so as to relatively move into latching relation with the strike when the door element is closed relative to the header element, and thereby hold the door closed. Also, in accordance with the invention, means is provided to control movement of the latch into and out of said latching relation with the strike, said means including a heat fusible part that, when fused, renders said control means inoperable to effect movement of the latch out of latching relation with the strike.

In the example, the latch may advantageously take the form of a starwheel 14 having arms 14*a* projecting outwardly relative to the vertical axis 15 of rotation of that wheel. FIG. 7 shows the wheel mounted on a shaft or axle 16 rotatable in a bearing or cylindrical socket 17 formed by a flange part 18*a* of a carrier frame 18. The flange part is split at 19 to pass the wheel as it rotates in response to door closing, at which time the strike crosspiece 13*a* becomes captivated between two arms of the starwheel, as seen in FIG. 2. Thus, if the wheel is blocked against rotation, relative to flange part 18*a*, the door is locked in closed position.

The means to control movement of the latch wheel 14 into and out of latching relation with the strike includes a heat fusible part such as that seen at 20. It consists of a material such as plastic or rubber (for example), which will melt or fuse at a pre-selected fire temperature (as for example between 250° F. and 350° F.), the rest of the holder assembly being resistant to fusion at that temperature and at any fire temperature usually encountered during a building fire. Such temperature can reach about 1,900° F.

As shown, the heat fusible part 20 has a T-shaped retainer 20*a* integral therewith and which closely fits a slot 21′ in a metallic holder plate 21. The legs 21*a* of plate 21 fit flatly against legs 22*a* of a 90° curved bracket 22 attached to a release link 23, and fasteners 90 attach legs 21*a* to legs 22*a*. The plates 21 and 22 form a keeper which interferes with or blocks starwheel rotation as in FIGS. 2 and 5.

Retainer 20*a* is affixed to part 21 so that steel pin 24 carried by part 20 extends vertically above a pocket 25 (see FIG. 6) into which the pin 24 drops by gravity when part 20 fuses or melts, during a fire. Pocket 25 is formed by the frame plate 26 and by the lower bracket leg 22, i.e. between upright walls 26*a* and 22*b* of these components. A lower wall 26*b* of plate 26 seats the dropped pin, in FIG. 6. In that position, the pin blocks rightward release movement of the keeper and release link 23, whereby the keeper edge 26*c* blocks rotation of the starwheel, and opening of the door is thereby blocked. This is despite pushing movement of the panic bar 27 attached to the release link, in a rightward direction so as normally to allow retraction of the keeper from the starwheel, and opening of the door.

A tension spring 30 normally urges the keeper into door locking relation with the starwheel, as seen in FIG. 2. One end 30*a* of the spring is attached to the release link, and the opposite end 30*b* of the spring is attached to the frame part 31. The frame is fastened to the door, as via fasteners 32.

The starwheel shaft 16 is fluted to define circumferentially spaced depressions 16*a* into which detent balls 33 are yieldably urged by compression springs 34. See FIG. 7. Thus, rotation o the starwheel from pre-determined angular position is yieldably resisted, those positions corresponding to starwheel positions in FIG. 2, in which the door is held closed, as by the positioning of a wheel spoke 14*a* facing the keeper edge 26*c*.

I claim:

1. In a door retention assembly that locks a door in closed position in response to high temperature as during a fire, the door element having an edge portion closable into adjacent relation to an edge portion defined by a header element, there being a strike carried by one of the elements, the combination comprising:

(a) a latch carried by the other element to relatively move into latching relation with the strike when the door element is closed relative to the header element, thereby to hold the door closed, (b) and control means to control movement of the latch into and out of said latching relation with the strike, said means including a heat fusible part that, when fused, renders said control means inoperable to effect movement of the latch out of latching relation with the strike, (c) said means including a jamming part directly carried only by said heat fusible part to become displaced into jamming relation with said control means in response to fusing of the fusible part, (d) said jamming part being a pin carried by said heat fusible part in a first position wherein said control means is not jammed, and said jamming part is dropped by said fusible part during heat fusing thereof, and into a second position wherein the control means is then jammed.

2. The combination of claim 1 wherein said part consists of plastic.

3. The combination of claim 1 wherein said latch includes a rotor engageable with the strike, and said control means includes a keeper movable into and out of rotation blocking relation with the rotor.

4. The combination of claim 3 wherein the assembly includes a frame, and the rotor comprises a starwheel carried by the frame for rotation, and the keeper is also carried by the frame for movement into and out of rotation blocking relation with the starwheel, said control means including a jamming part carried by the heat fusible part to become displaced into jamming relation between the keeper and frame, in response to fusing of the fusible part.

5. The combination of claim 4 wherein the keeper and frame form a pocket into which the jamming part drops in response to release of the jamming part by the heat fusible part in response to fusing of the fusible part, the heat fusible part being T-shaped, and the keeper having a slot to interfit the T-shaped heat fusible part, the jamming part suspended below the slot, to overhand the pocket.

6. The combination of claim 5 wherein said heat fusible part is carried by the keeper, and the jamming part is carried by the heat fusible part to overhang the pocket.

7. The combination of claim 5 including a panic bar operatively connected to said keeper, and carried by the door element.

8. The combination of claim 1 wherein the heat fusible part consists of a material which fuses at a temperature below 350° F., and the remainder of the assembly consists of a material or materials that do not fuse below 1,900° F.

* * * * *